US011802249B2

(12) United States Patent
Ray et al.

(10) Patent No.: US 11,802,249 B2
(45) Date of Patent: Oct. 31, 2023

(54) METHOD FOR REACTIVE DESULFURIZATION OF CRUDE OIL AND SULFUR RICH PETROLEUM REFINERY FRACTIONS

(71) Applicant: Council of Scientific and Industrial Research, New Delhi (IN)

(72) Inventors: Anjan Ray, Dehradun (IN); Thangaraj Senthilkumar, Dehradun (IN); Umesh Kumar, Dehradun (IN); Vedant Joshi, Dehradun (IN); Sudip Kumar Ganguly, Dehradun (IN)

(73) Assignee: Council of Scientific and Industrial Research, New Delhi (IN)

( * ) Notice: Subject to any disclaimer, the term of this patent is extended or adjusted under 35 U.S.C. 154(b) by 0 days.

(21) Appl. No.: 17/663,987

(22) Filed: May 18, 2022

(65) Prior Publication Data

US 2023/0091449 A1 Mar. 23, 2023

(30) Foreign Application Priority Data

Aug. 13, 2021 (IN) ..... 202111036981

(51) Int. Cl.
*C10G 49/04* (2006.01)
*C10G 49/26* (2006.01)

(52) U.S. Cl.
CPC ..... *C10G 49/04* (2013.01); *C10G 49/26* (2013.01); *C10G 2300/1033* (2013.01)

(58) Field of Classification Search
CPC . C10G 49/04; C10G 49/26; C10G 2300/1033
See application file for complete search history.

(56) References Cited

U.S. PATENT DOCUMENTS 4,987,042 A 1/1991 Friedrich et al.
6,602,974 B1 8/2003 McCullough et al.
6,846,406 B2 * 1/2005 Canos ..... B01J 29/89 208/240

(Continued)

FOREIGN PATENT DOCUMENTS

CN 104045770 A 9/2014
WO 2015070028 A2 5/2015

OTHER PUBLICATIONS

Khenkin et al. ("Desulfurization of Hydrocarbons by Electron Transfer Oxidative Polymerization of Heteroaromatic Sulfides Catalyzed by H5PV2Mo10O40 Polyoxometalate." ChemSusChem 2011, 4, 346-348) (Year: 2011).*

(Continued)

*Primary Examiner* — In Suk C Bullock
*Assistant Examiner* — Jason Y Chong
(74) *Attorney, Agent, or Firm* — Workman Nydegger

(57) ABSTRACT

A method for desulfurizing crude oil and sulfur rich petroleum refinery fractions is disclosed. The method includes feeding the crude oil and sulfur rich petroleum refinery fractions to a reactor. An oxidation catalyst is added to the crude oil and sulfur rich petroleum refinery fractions. The crude oil and sulfur rich petroleum refinery fractions and the oxidation catalyst are stirred to form co-polymers of sulfur-containing heterocyclic compounds. The co-polymers of sulfur-containing heterocyclic compounds are separated by filtration or by centrifugation.

17 Claims, 10 Drawing Sheets

(56) References Cited

U.S. PATENT DOCUMENTS

| | | | |
|---|---|---|---|
| 7,098,294 | B2 | 8/2006 | McCullough et al. |
| 2008/0188637 | A1 | 8/2008 | Rieke |
| 2016/0039957 | A1 | 2/2016 | Al-Malki |

OTHER PUBLICATIONS

Niemi et al. ("Polymerization of 3-alkylthiophenes with FeCl3." Polymer 33.7 (1992): 1559-1562) (Year: 1992).*

A. Demirbas et al., "API Gravity, Sulfur Content, and Desulfurization of Crude Oil", Petroleum Science and Technology, Jan. 2015, 33, pp. 93-101.

"IMO 2020—cutting sulphur oxide emissions", International Maritime Organization, 2019, https://www.imo.org/en/MediaCentre/HotTopics/Pages/Sulphur-2020.aspx.

Chrysalidis et al., "Applied Cleaning Methods of Oil Residues from Industrial Tanks", Processes, May 11, 2020, 8, 569.

Javadli et al., "Desulfurization of heavy oil", Appl. Petrochem. Res., Mar. 1, 2012, 1, 3-19.

Swanston, Jonathan, "Thiophene", Ullmann's Encyclopedia of Industrial Chemistry, Weinheim: Wiley-VCH., Jun. 15, 2000, vol. 36, pp. 657-669, doi: 10.1002/14356007.a26_793.pub2.

Miyakoshi et al., "Synthesis of Poly(3-hexylthiophene) with a Narrower Polydispersity", Macromolecular Rapid Communications, Jul. 20, 2004, vol. 25, pp. 1663-1666.

Qiao et al., "The FeCl3-doped poly(3-alkylthiophenes) in the solid-state", Synthetic Metals, 2001, 122, pp. 449-454.

Kaputskii et al., "Synthesis of Petroleum Polymeric Resin by Cationic Polymerization of the C9 Fraction", Russian Journal of Applied Chemistry, Nov. 6, 2002, vol. 75, pp. 1006-1008.

Ibragimov et al., "Synthesis of Petroleum Polymer Resin by Catalytic Polymerization of Pyrocondensate and Its Fractions," American Chemical Science Journal, Oct. 21, 2013, 4(1), 82-96.

Brum et al., "Synthesis of hydrocarbon polymers by cationic polymerization and their thermal properties," Designed Monomers and Polymers, Dec. 3, 2012, DOI:10.1080/15685551.2012.747145.

* cited by examiner $^1$H NMR of Gasoline fraction $^1$H NMR of polymer (P6)

$^1$H NMR of Diesel fraction $^1$H NMR of polymer (P8)

METHOD FOR REACTIVE DESULFURIZATION OF CRUDE OIL AND SULFUR RICH PETROLEUM REFINERY FRACTIONS

CROSS-REFERENCE TO RELATED APPLICATIONS

This application claims the benefit of and priority to IN Provisional Patent Application No. 202111036981, filed 13 Aug. 2021, the entire disclosure of which is hereby incorporated by reference as if set forth in its entirety herein

TECHNICAL FIELD

The present application relates generally to a method for desulfurization of crude oil and sulfur rich petroleum refinery fractions, more in particular to a method that simultaneously generates polythiophene and other polymers along with desulfurizing the crude oil.

BACKGROUND

Refinery petroleum fractions, such as naphtha, gasoline, kerosene, diesel, Light cycle oil (LCO), vacuum gas oil (VGO), heavy residue oil (HRO), foots oil, fuel oil, and visbreaking tar (VisTar) streams, often have high content of Sulfur-Containing Heterocyclic Aromatic compounds (SCHAC). Bulky SCHACs are problematic when present in petroleum refinery fractions, as they cause corrosion of assets and are responsible for low fuel quality, health, and environmental problems. SCHAC are difficult to remove from petroleum fractions by conventional techniques such as hydrodesulfurization (HDS). Severe conditions of temperature and pressure are required for the deep desulfurization of SCHAC derivatives and their alkylated/alicyclic derivatives. Such sulfur residues thus either typically remain in the petroleum crude or product streams, causing these streams to be sold at a lower price or significant capital assets/cost, operating expenses and use of processes related to the generation of greenhouse gas (GHG) emissions to produce saleable products amenable to market needs.

Due to air quality concerns, sulfur content limits in petroleum-derived transportation fuels like diesel and gasoline have been falling steadily across the world since the beginning of the $21^{st}$ century. More recently, the International Maritime Organization (IMO) has mandated a steep reduction in the sulfur content of marine fuels. As a consequence of this, high-sulfur crudes (referred to in the trade as "sour" crudes) trade at a significant discount to low-sulfur "sweet" crudes. Further, due to the higher tendency of sour crudes to induce corrosion, the high additional cost is incurred from tankage, process equipment, and pipeline maintenance point of view in handling, storage, and transportation of sour crudes and other petroleum-derived fractions and streams compared to the corresponding sweet crude counterparts.

Many efforts have also been made to reduce sulfur content in crude oil and in various derived petroleum refinery fractions. Such reduction of sulfur is essential for regulatory compliance, for suitability in fuel using equipment such as vehicles and furnaces, and for reducing corrosion of assets—but typically requires considerable additional equipment and processing effort at elevated temperatures and pressures. Approaches to desulfurization are broadly categorized into two types. (a) HDS; and (b) non-HDS techniques; HDS is the most used desulfurization technique used in the petroleum industry. HDS is performed with the help of a catalyst or by the conventional HDS with hydrogen. The non-HDS approach is further sub-classified into various techniques. (i) extractive desulfurization, (ii) adsorptive desulfurization, (iii) oxidative desulfurization (iv) chemical oxidation (v) photochemical oxidation (vi) ultrasound oxidation, (vii) biodesulfurization, (viii) anaerobic biodesulfurization.

The sulfur compounds present in petroleum crude oil and refinery fractions typically occur in three major categories of molecules: light sour gases (hydrogen sulfide and carbon oxysulfide), mercaptans (also referred to as thiols), and thiophenes, including thiophene derivatives such as benzothiophenes, dibenzothiophenes and various alkylated/alicyclic compounds of SCHAC. The SCHAC contain alkyl/alicyclic chains, whose length may vary from 1 to 30 carbons, which may be linear, branched, or in some cases may also contain cyclic structures. SCHACs such as thiophenes, benzothiophenes, and dibenzothiophenes are used to produce various agrochemicals and pharmaceuticals.

In a further study, it was found that the polymers obtained from SCHACs exhibit conductive and optical properties that are desirable for various commercial and industrial applications. Specifically, polythiophene and its derivatives are currently used in chemical sensors, solar cells, and batteries. Polythiophene can be chemically synthesized using oxidation catalyst or cross-coupling catalysts.

Yet another study discloses apparatus and processes for manufacturing polymers of thiophene, benzothiophene, and their alkylated/alicyclic derivatives. Additionally, a process was described for manufacturing polymers that includes isolating a SCHAC from cracked naphtha (the lightest fraction of crude oil that may be liquid under ambient conditions) and reacting the SCHAC to produce a polymer thereby in presence of a superacid ($CF_3SO_3H$) catalyst.

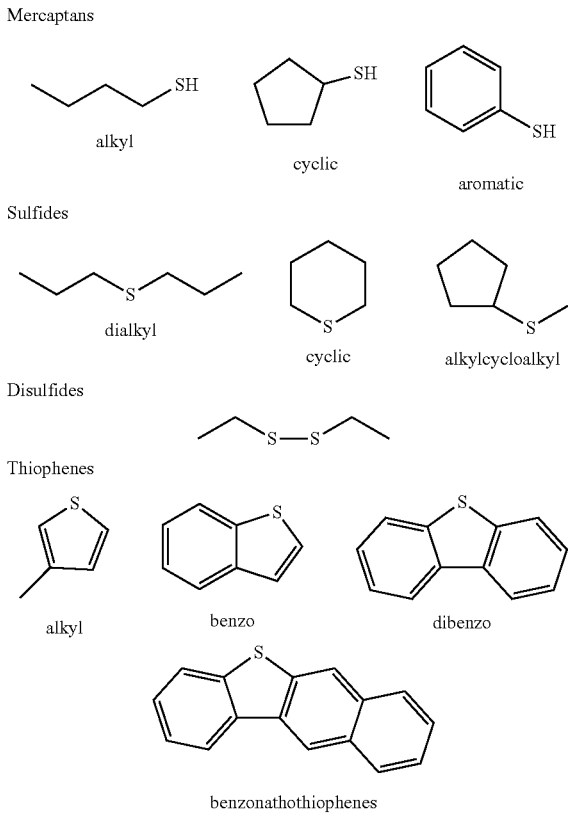

In another study, polythiophene-based polymers were prepared using $FeCl_3$ catalyst at room temperature using the commercially obtained monomers. Such chemical synthesis typically results in a reaction mixture from which the polythiophene can be separated.

Despite the above-described processes and methods, significant removal of sulfur from petroleum crude oil and its refinery fractions by polymerization is a challenging task, and complete removal is arduous and expensive. This is because the derivatives present in the petroleum refinery fractions are highly complex and derivatized with many substituents, complex molecular structures of the aromatic sulfur moieties.

It would, therefore, be beneficial to develop a synthesis method that could not only remove thiophene, benzothiophene, and their alkylated/alicyclic derivatives either from crude oil directly or at some stage of the crude oil (petroleum) refining process, while simultaneously generating useful products from the SCHAC contained in petroleum crude oil or its refinery fractions such as naphtha, gasoline, kerosene, diesel, LCO, VGO, HRO, foots oil, fuel oil, and VisTar streams.

Therefore, developing an efficient methodology to significantly reduce or eliminate sulfur monomers present in petroleum crude oil itself or in refinery fractions including, but not limited to naphtha, gasoline, kerosene, diesel, LCO, VGO, HRO, foots oil, fuel oil, and VisTar streams and different crude oils, etc. is needed.

SUMMARY

This summary is provided to introduce a selection of concepts in a simplified form that are further described below in the Detailed Description section. This summary is not intended to identify or exclude key features or essential features of the claimed subject matter, nor is it intended to be used as an aid in determining the scope of the claimed subject matter.

According to one aspect, embodiments relate to a method for desulfurizing crude oil and sulfur rich petroleum refinery fractions. The method includes feeding the crude oil and sulfur rich petroleum refinery fractions to a reactor. An oxidation catalyst is added to the crude oil and sulfur rich petroleum refinery fractions. The crude oil and sulfur rich petroleum refinery fractions and the oxidation catalyst are stirred to form co-polymers of sulfur-containing heterocyclic compounds. The co-polymers of sulfur-containing heterocyclic compounds are separated by filtration or by centrifugation.

BRIEF DESCRIPTION OF DRAWINGS

Non-limiting and non-exhaustive embodiments of the invention are described with reference to the following figures, wherein like reference numerals refer to like parts throughout the various views unless otherwise specified.

Further, persons skilled in the art to which this disclosure belongs will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those of ordinary skill in the art having the benefit of the description herein.

DETAILED DESCRIPTION

For the purpose of promoting an understanding of the principles of the disclosure, reference will now be made to the embodiment(s) illustrated in the figures and specific language will be used to describe them. It will nevertheless be understood that no limitation of the scope of the disclosure is thereby intended. Such alterations and further modifications to the disclosure, and such further applications of the principles of the disclosure as described herein being contemplated as would normally occur to one skilled in the art to which the disclosure relates are deemed to be a part of this disclosure.

It will also be understood by those skilled in the art that the foregoing general description and the following detailed description are exemplary and explanatory of the disclosure and are not intended to be restrictive thereof.

The terms "comprises," "comprising," or any other variations thereof, are intended to cover a non-exclusive inclusion, such that a process or method that comprises a list of steps does not include only those steps but may include other steps not expressly listed or inherent to such a process or a method. Similarly, one or more devices or sub-systems or elements or structures or components preceded by "comprises . . . a" does not, without more constraints, preclude the existence of other devices, other sub-systems, other elements, other structures, other components, additional devices, additional sub-systems, additional elements, additional structures, or additional components. Appearances of the phrase "in an embodiment," "in another embodiment" and similar language throughout this specification may, but do not necessarily, all refer to the same embodiment.

Unless otherwise defined, all technical and scientific terms used herein have the same meaning as commonly understood by one of ordinary skill in the art to which this disclosure belongs. The system, methods, and examples provided herein are illustrative only and not intended to be limiting.

Embodiments of the present disclosure will be described below in detail with reference to the accompanying figures.

Figure 1:
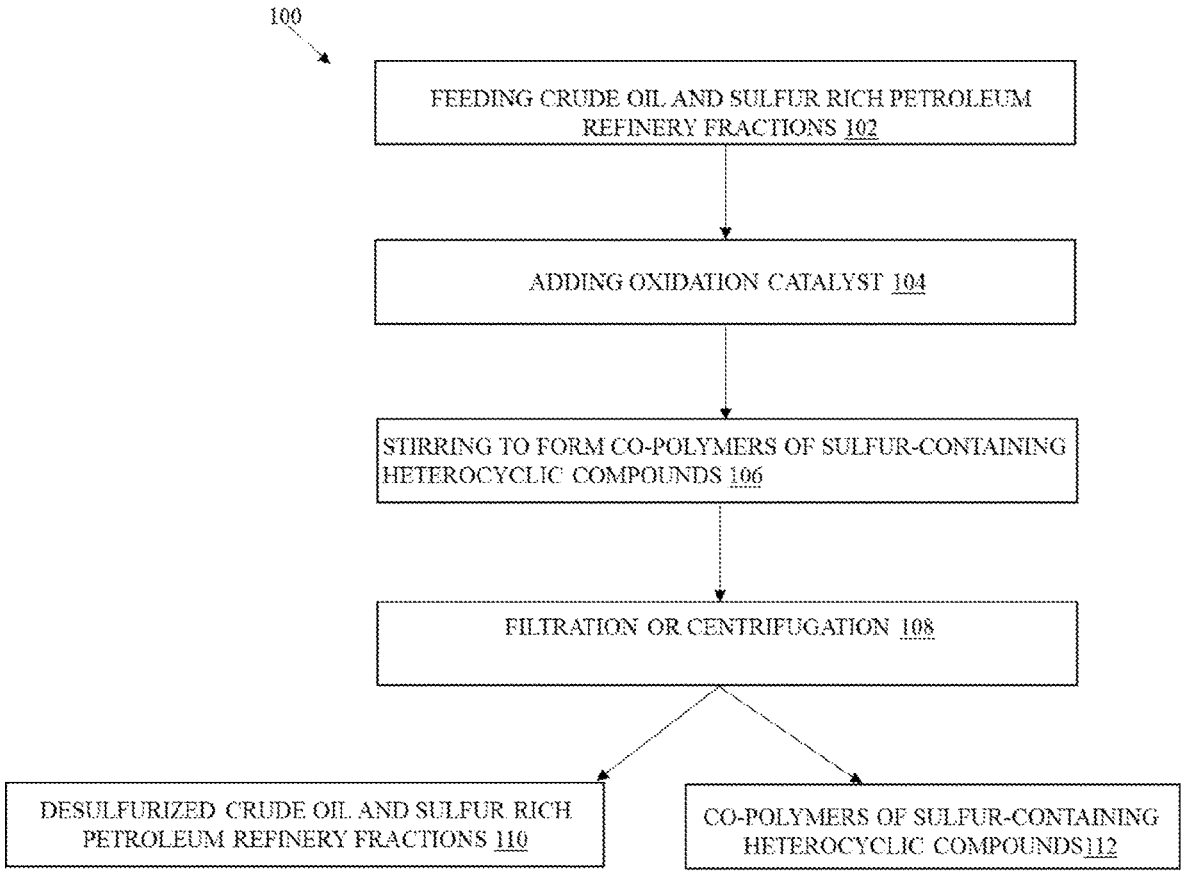
FIG. 1 is a flow chart for a method for desulfurization of crude oil and sulfur rich petroleum refinery fractions.
Figure 2:
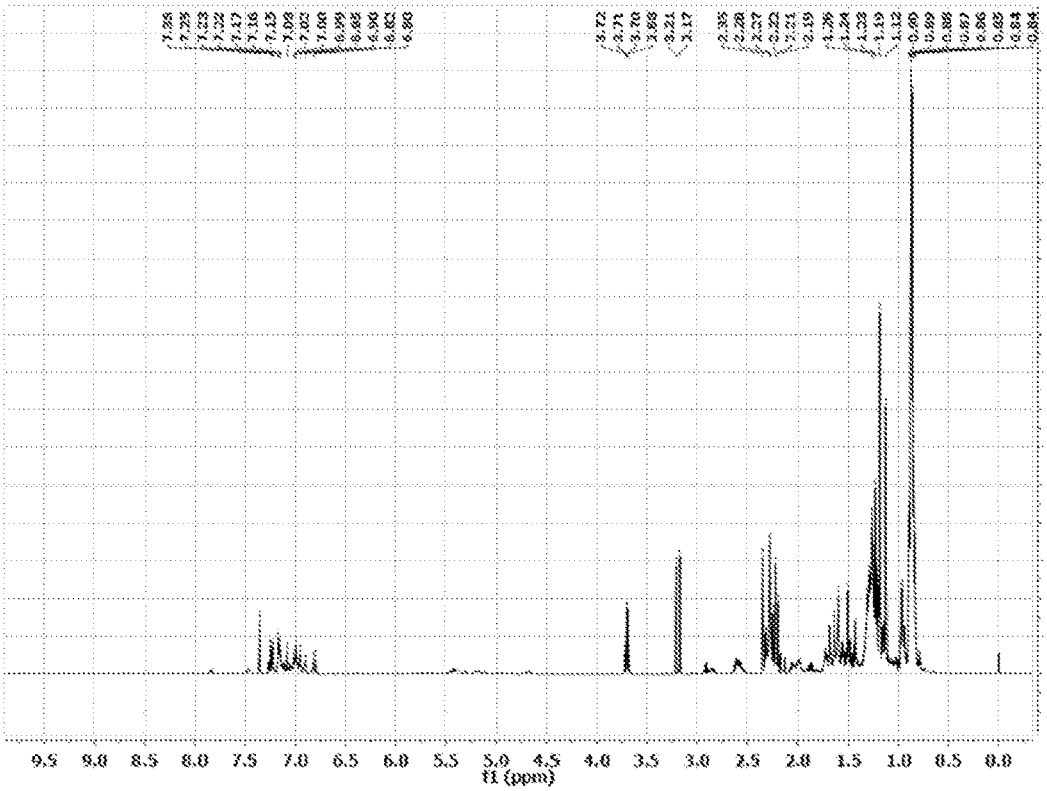
FIG. 2 is the $^1$H NMR spectra of the gasoline, and polymer (P6) obtained after polymerization of the gasoline fraction, in accordance with an embodiment of the present disclosure.
Figure 2:
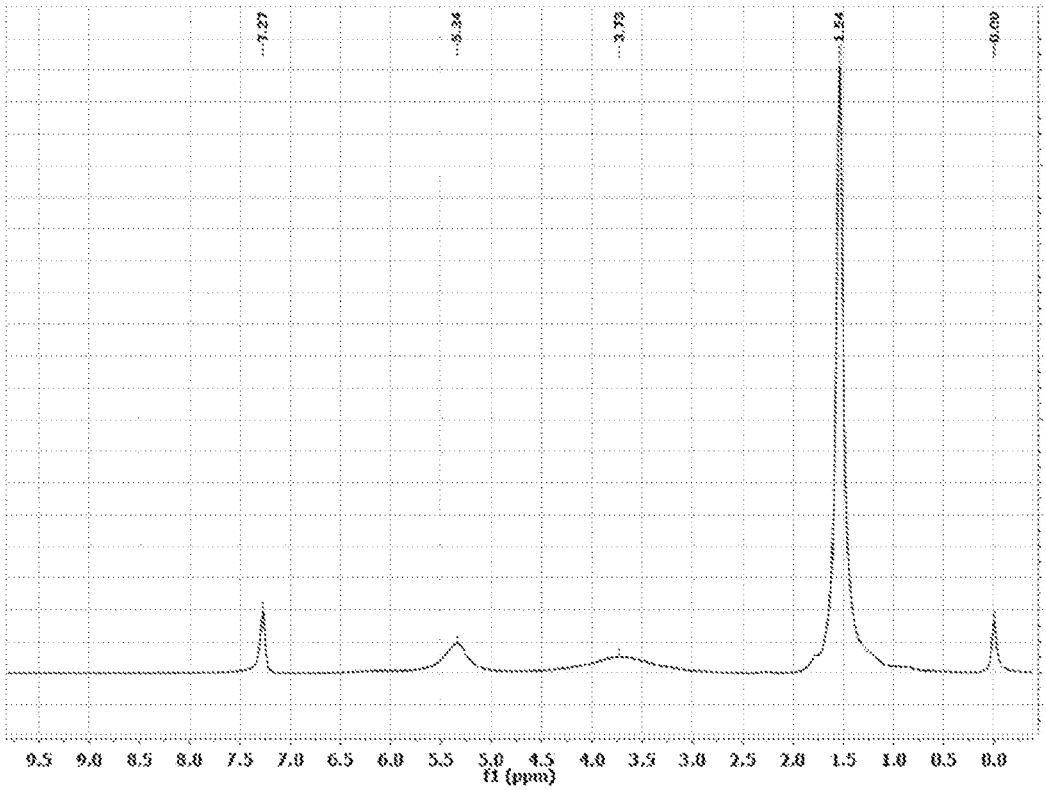

FIG. 1 is a flow chart for a method for desulfurization of crude oil and sulfur rich petroleum refinery fractions. The method 100 includes step 102 where the crude oil and sulfur rich petroleum refinery fractions are fed to a reactor. At step 104, an oxidation catalyst is added to the crude oil and sulfur rich petroleum refinery fractions. Step 104 is followed by step 106, where the crude oil and sulfur rich petroleum refinery fractions and the oxidation catalyst are stirred to form co-polymers of sulfur-containing heterocyclic compounds. At step 108, the co-polymers of sulfur-containing heterocyclic compounds are separated by filtration or by centrifugation.

According to the specification, sulfur is removed from petroleum crude oil and refinery fractions and is effectively utilized in situ to synthesize a new family of copolymers, namely poly (thiophene-co-benzothiophene-co-dibenzothiophene) with or without alkyl/alicyclic substituted derivatives via oxidative polymerization of thiophene, benzothiophene, dibenzothiophene, and other alkylated/alicyclic derivative of SCHAC monomers present in petroleum refinery fractions. The petroleum refinery fractions may be naphtha, gasoline, kerosene, diesel, LCO, VGO, HRO, foots oil, fuel oil, and VisTar streams.

The petroleum crude oil and refinery fractions such as naphtha, gasoline, kerosene, diesel, LCO, VGO, HRO, foots oil, fuel oil, and VisTar streams containing at least 0.005 wt % sulfur are processed to reduce the sulfur content by at least 1% with respect to what is present in the untreated crude. The removal process simultaneously synthesizes poly (thiophene-co-benzothiophene-co-dibenzothiophene) and copolymers of their alkyl/alicyclic derivatives. The copolymers thus developed have UV absorbing capabilities, low electrical resistivity, fluorescence, thermochromism, electrochromism, and photochromism depending on the sulfur species present in the starting feedstock used.

A synthetic method to reduce sulfur monomers from petroleum crude oil and refinery fractions such as naphtha, gasoline, kerosene, diesel, LCO, VGO, HRO, foots oil, fuel oil, and VisTar streams by polymerization of SCHAC using oxidation catalyst is disclosed. The synthesized conducting copolymers poly(thiophene-co-benzothiophene-co-dibenzothiophene) have a formula

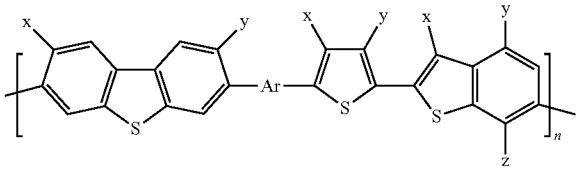

x = H, R
y = H, R
z = H, R wherein R is alkyl/alicyclic chain substituents, and Ar represents the higher aromatic rings.

In another embodiment, conjugated copolymers of thiophene, benzothiophene, dibenzothiophene, and higher analogues of sulfur monomers functionalized with alkyl/alicyclic side-chain substituents of formula (I) are disclosed. SCHAC monomers appended with alkyl/alicyclic chain substituents may also be copolymerized using the same synthesis methodology.

The petroleum fractions such as naphtha, gasoline, kerosene, diesel, LCO, VGO, HRO, foots oil, fuel oil, and VisTar streams have different weight percentages of sulfur monomers, and different types of sulfur monomers. Such sulfur monomers are polymerized using Fe(III)chloride and other oxidation catalysts. In some embodiments, the oxidation occurs in presence of solvents, such as toluene, chloroform, hexane, tetrahydrofuran, 1,4-dioxane, or methylene chloride.

In yet another embodiment, a method of desulfurizing the petroleum crude oils and refinery fractions via copolymerization of the SCHAC using an oxidation catalyst is disclosed. The method comprises synthesizing conducting copolymers, i.e., poly(thiophene-co-benzothiophene-co-dibenzothiophene), with or without aliphatic and/or alicyclic side chains. The copolymers are separated from the crude samples by filtration/centrifugation. The filtrate is analyzed for the sulfur content, which is compared with the actual crude used. The highest desulfurization percentage of 91% for LCO is achieved, whereas crude oil with API-26 showed the desulfurization of 20%. This result clearly indicates the nature and composition of crude affect the polymerization and desulfurization efficiency. The polymerization reaction was performed under solvent-free conditions, which directly uses the actual crude samples and underscores the potential and wide applicability of the method. In some embodiments, with the petroleum crude oil with high viscosity, polymerization reaction was performed in presence of solvents such as toluene, hexane, chloroform, THF, and DCM for increasing the rate of polymerization reaction. The number average molecular weight of the copolymers was found to be in the range of 500-5000 with a yield ranging from 5 to 40%.

The polymerization reaction was performed under different experimental conditions to realize the efficacy of the method. The reaction time of the polymerization was varied from minutes to hours to days. The results demonstrated that 24 h of reaction time was optimum for the desulfurization of the crude oil and 12 h for petroleum refinery fractions. The amount of catalyst played a crucial role in the polymerization reaction, and the results showed that increasing the catalyst amount increased the yield of the polymerization reaction and also increased the degree of desulfurization. The potential oxidation catalyst used in the polymerization reactions were Fe(III)chloride, Fe(III)nitrate, Fe(III) sulfate, Fe(III)Phthalocyanine, Cu(II)acetate, Pd(II)acetate, Zn(II) acetate, Ni(II)phthalocyanine, Zn(II)phthalocyanine, Zn(II) chloride, Ni(II)acetate, Ni(II)chloride, Ni(II)nitrate, $HAuCl_4$, vanadyl acetyl acetonate, and molybdenum acetyl acetonate and also mixed metal catalysts which are listed in Table-3.

From the sulfur analysis, $FeCl_3$ is found to be the most efficient catalyst for polymerization reactions and effective desulfurization of petroleum crude oils and refinery fractions. The process tolerates and may operate over a wide range of $FeCl_3$ catalyst concentration. $FeCl_3$ was varied from 10 wt % to as low as 0.01 wt %. The NMR, and FT-IR characterizations of the polymers confirm the increase in aromatic content in polymers and confirm the basic SCHAC core. The absorption measurements show a broad absorption of the polymers compared to their crude counterparts with red-shifted absorptions. The absorption spectra of the copolymers show a bathochromic shift with peaks at 325 and 370 nm. Similarly, emission spectra of the copolymers show broad emission bands up to 700 nm with a maximum at 470 nm and also red-shifted emission due to increased conjugation. The copolymers produced exhibit improved chemical and physical properties in comparison to the existing polymers. These polymers find applications in anticorrosion. The polymers possess UV absorbing capabilities, low electrical resistivity, fluorescence, thermochromism, electrochromism, and photochromism, depending on the sulfur species present in the starting feedstock used.

Sulfur-based conjugated copolymers of formula (I) are synthesized from crude oil of API 15-40 using oxidation catalyst including $FeCl_3$ and other transition metal salts including their nitrates, acetates, phthalocyanines, halides, carbonates, acetyl acetonates, sulphates, and other salts as catalyst. The sulfur monomers are polymerized using the oxidation catalyst and the resulting polymers are separated by filtration/centrifugation. The separated polymers and the remaining crude have been analyzed for the sulfur content in the samples, and the results are summarized in Table 1.

From Table 1, it is clear that sulfur content in the various crude oils has been reduced by 1% depending on the type of crude oil used. This indicates the successful removal of SCHAC monomers from the crude oils. The obtained polymers have been tested for the analysis of sulfur content, and the results are given in Table 1. This indicates the successful removal of sulfur monomers from the petroleum refinery fractions. The variation in the removal of sulfur monomers from petroleum refinery fractions are different because the weight percentage, nature, and composition of sulfur monomers present in each refinery fractions are different. The variation in the removal of SCHAC monomers from crude is different because the weight percentage, nature, and composition of sulfur monomers present in each petroleum crude oil are different. For the model studies, thiophene, benzothiophenes, and dibenzothiophenes from commercial sources are polymerized separately to obtain polythiophenes, polybenzothiophenes and polydibenzothiophenes are shown in Scheme 1.

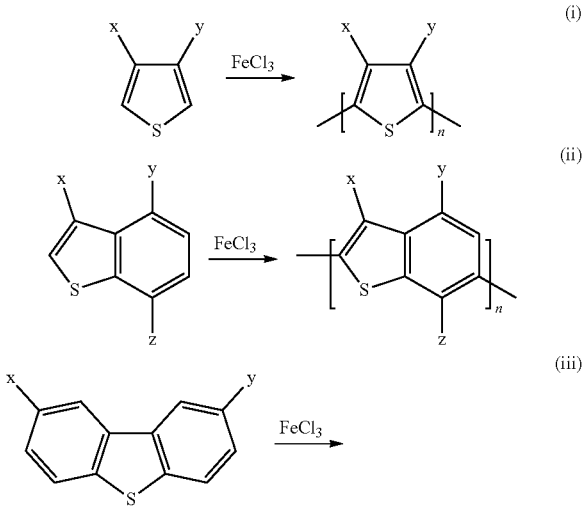

-continued

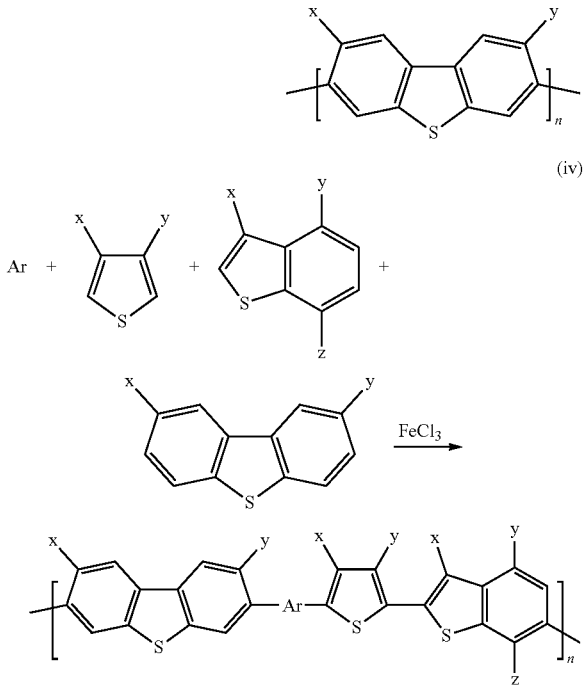

Table 1 provides a summary of petroleum crude oils, reaction parameters, polymer yields, and sulfur content analysis. The sulfur monomers are polymerized using the oxidation catalyst, and the resulting polymers are separated by simple filtration/centrifugation. The separated polymers and the crude have been analyzed for the sulfur content, and the results are summarized in Table 1. Table 2 provides a summary of petroleum refinery fractions, reaction parameters, polymer yields, and sulfur content analysis as shown below.

TABLE 1

| S. No | Name of sample | Quantity of feed sample (g) | Dosage of catalysts (g) | Reaction time (h) | Temperature (° C.) | Polymer yield (g) | Sulfur content (%) | Sulfur reduction in % |
|---|---|---|---|---|---|---|---|---|
| 1 | | | | API-40 crude | | | 0.0650 | |
| 2 | API-40-P1 | 25 | 1 | 6 | 25 | 8.06 | 0.0371 | 43.03 |
| 3 | API-40-P1 | 25 | 1 | 6 | 70 | 11.6 | 0.0168 | 54.72 |
| 4 | | | | API-26 crude | | | (0.302) | |
| | | | | API-26 + hexane | | | 0.1550 | |
| 5 | API-26-P2 | 20 | 1 | 12 | 70 | 5.04 | 0.122 | 20 |
| 6 | API-26-P2 | 20 | 0.1 | 12 | 70 | 3.5 | 0.144 | 7.1 |
| 7 | API-26-P2 | 20 | 0.01 | 12 | 70 | 3.39 | 0.149 | 3.88 |
| 8 | API-26-P2 | 20 | 0.002 | 12 | 70 | 0.659 | 0.1534 | 1 |
| 9 | | | | API-18 crude | | | 0.268 | |
| 10 | API-18-P3 | 20 | 1 | 12 | 70 | 4.82 | 0.230 | 14.2 |
| 11 | | | | API-15 crude | | | 1.456 | |
| 12 | API-15-P4 | 20 | 1 | 12 | 70 | 7.56 | 1.081 | 25.93 |
| 13 | API-15-P4 | 20 | 1 | 12 | 70 | 8.24 | 1.134 | 22.2 |

TABLE 2

| Sl. No. | Name of sample | Quantity of feed (g) | Dosage of catalysts (g) | Reaction time (h) | Temperature (° C.) | Polymer yield (g) | Sulfur content %) | Sulfur reduction in % |
|---|---|---|---|---|---|---|---|---|
| 1 | | | Naphtha untreated | | | | 0.764 | |
| 2 | Naphtha-P5 | 20 | 1 | 12 | 25 | 1.49 | 0.517 | 32.4 |
| 3 | | | Gasoline untreated | | | | 0.0130 | |
| 4 | Gasoline-P6 | 20 | 1 | 12 | 25 | 0.35 | 0.0086 | 32.3 |
| 5 | | | Kerosene untreated | | | | 0.0271 | |
| 6 | Kerosene-P7 | 20 | 1 | 12 | 70 | | 0.0259 | 4.43 |
| 7 | | | Diesel untreated | | | | 0.0080 | |
| 8 | Diesel-P8 | 20 | 1 | 12 | 25 | 0.45 | 0.0076 | 5 |
| 9 | | | LCO untreated | | | | 0.914 | |
| 10 | LCO-P9 | 20 | 1 | 12 | 25 | 1.4 | 0.084 | 90.81 |
| 11 | LCO-P9 | 20 | 0.1 | 12 | 25 | 1.4 | 0.709 | 22.5 |
| 12 | LCO-P9 | 20 | 0.01 | 12 | 25 | 1.4 | 0.905 | 1.01 |
| 13 | | | VGO untreated | | | | 0.0750 | |
| 14 | VGO-P10 | 10 | 1 | 12 | 70 | 2.68 | 0.0170 | 77.32 |
| 15 | | | HRO untreated | | | | 2.974 | |
| 16 | HRO-P11 | 20 | 1 | 12 | 100 | 3.47 | 2.853 | 4.07 |
| 17 | | | Foot's oil untreated | | | | 0.309 | |
| 18 | Foot's oil-P12 | 20 | 1 | 12 | 70 | 1.5 | 0.0272 | 91.2 |
| 19 | | | Fuel oil untreated | | | | 1.516 | |
| 20 | Fuel oil-P13 | 20 | 1 | 12 | 70 | | 1.075 | 29.1 |
| 21 | | | VisTar untreated | | | | 0.0466 | |
| 22 | VisTar-P14 | 10 | 1 | 12 | 70 | 1.2 | 0.0320 | 31.4 |

The metals and anions used as catalysts in the polymerization process are listed in Table 3.

TABLE 3

| S. No. | Oxidation catalyst |
|---|---|
| | (a) List of single metal oxidation catalyst used in a polymerization reaction |
| 1 | Fe(III)chloride |
| 2 | Fe(III)nitrate |
| 3 | Fe(III) sulfate |
| 4 | Fe(III)Phthalocyanine |

TABLE 3-continued

| S. No. | Oxidation catalyst |
|---|---|
| 5 | Cu(II)acetate |
| 6 | Pd(II)acetate |
| 7 | Ni(II)phthalocyanine |
| 8 | Zn(II)phthalocyanine |
| 9 | Cu(II)acetate |
| 10 | Zn(II)acetate |
| 11 | Zn(II)chloride |
| 12 | Ni(II)acetate |
| 13 | Ni(II)chloride |
| 14 | Ni(II)nitrate |

TABLE 3-continued

| S. No. | Oxidation catalyst |
|---|---|
| 15 | $HAuCl_4$ |
| 16 | vanadyl acetylacetonate |
| 17 | molybdenum acetylacetonate |

Figure 3:
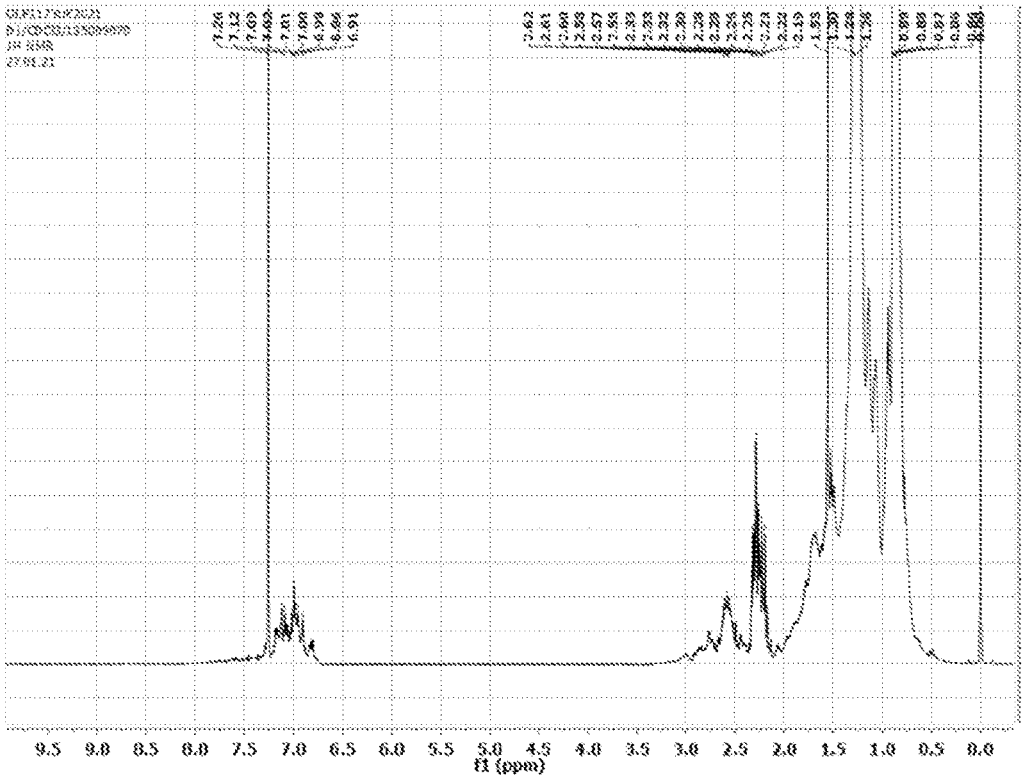
FIG. 3 is the $^1$H NMR spectra of the diesel, and polymer (P8) obtained after polymerization of the diesel fraction, in accordance with an embodiment of the present disclosure.
Figure 3:
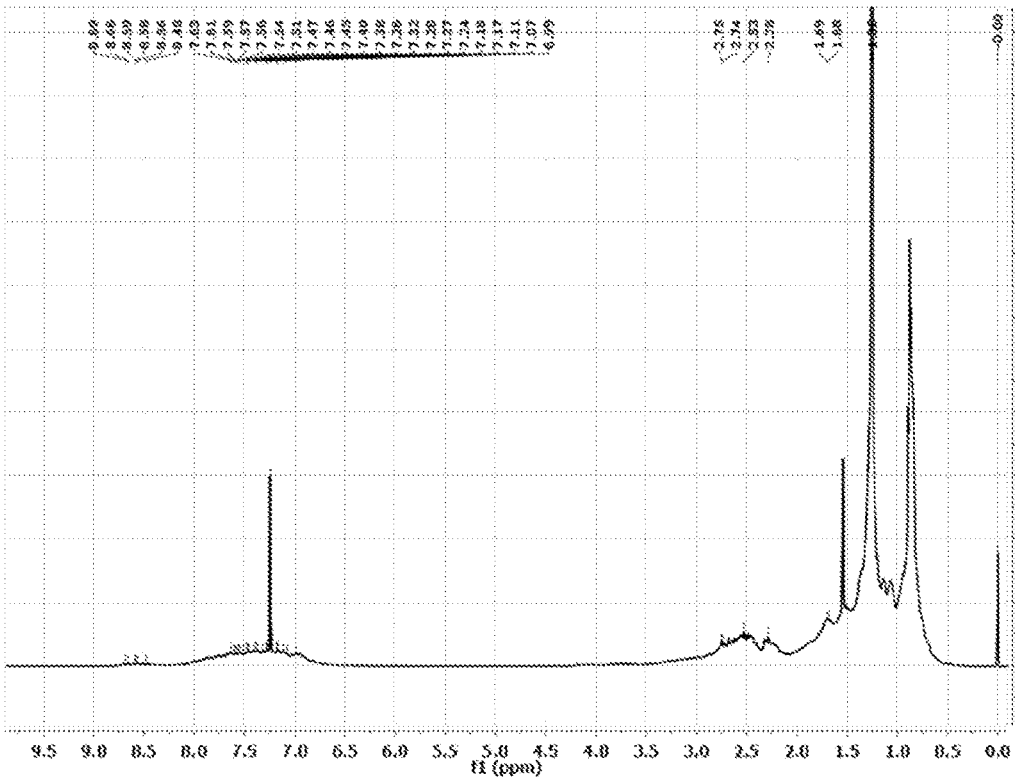
Figure 4:
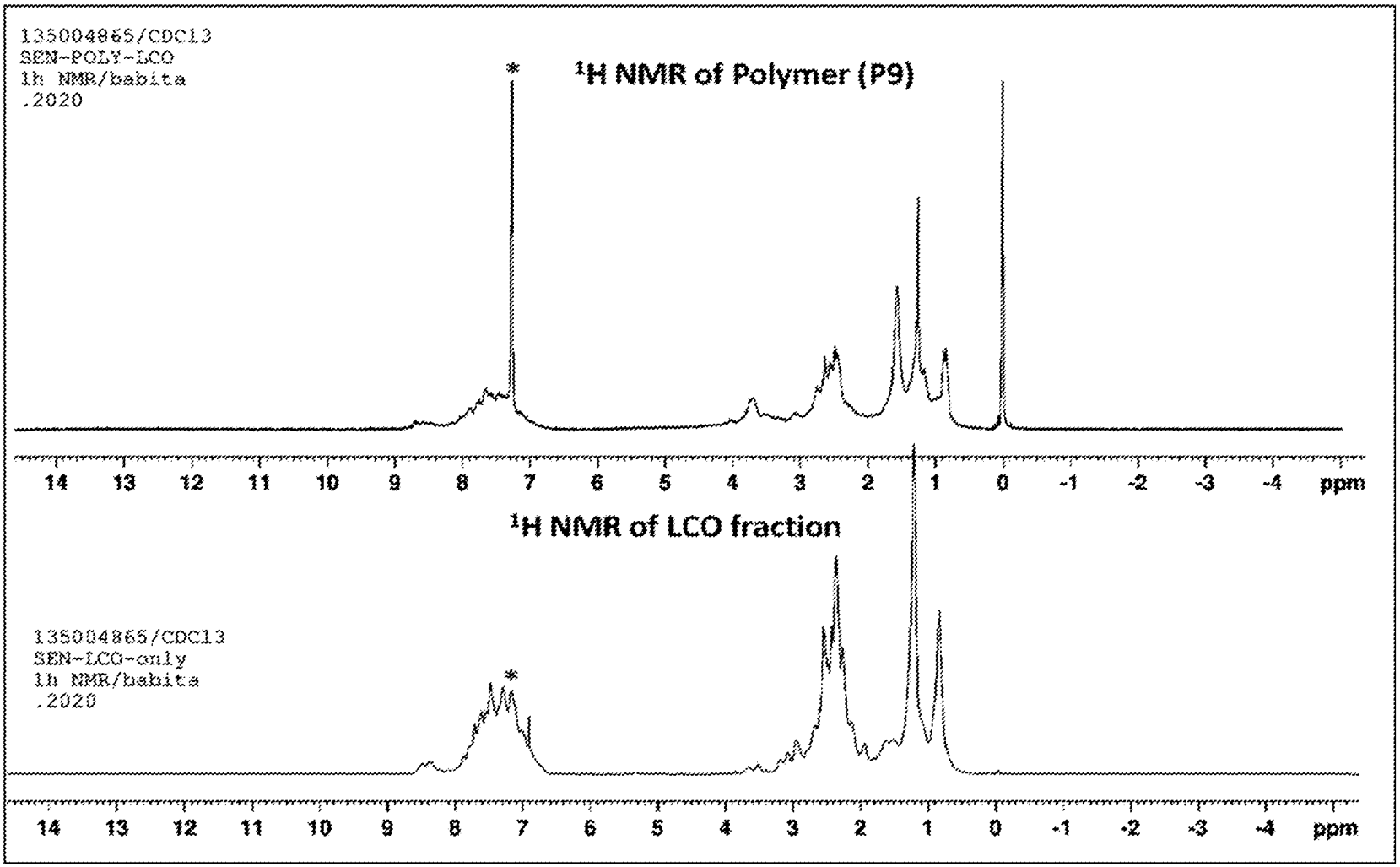
FIG. 4 is the $^1$H NMR spectra of the LCO, and polymer (P9) obtained after polymerization of the LCO fraction, in accordance with an embodiment of the present disclosure.
Figure 5:
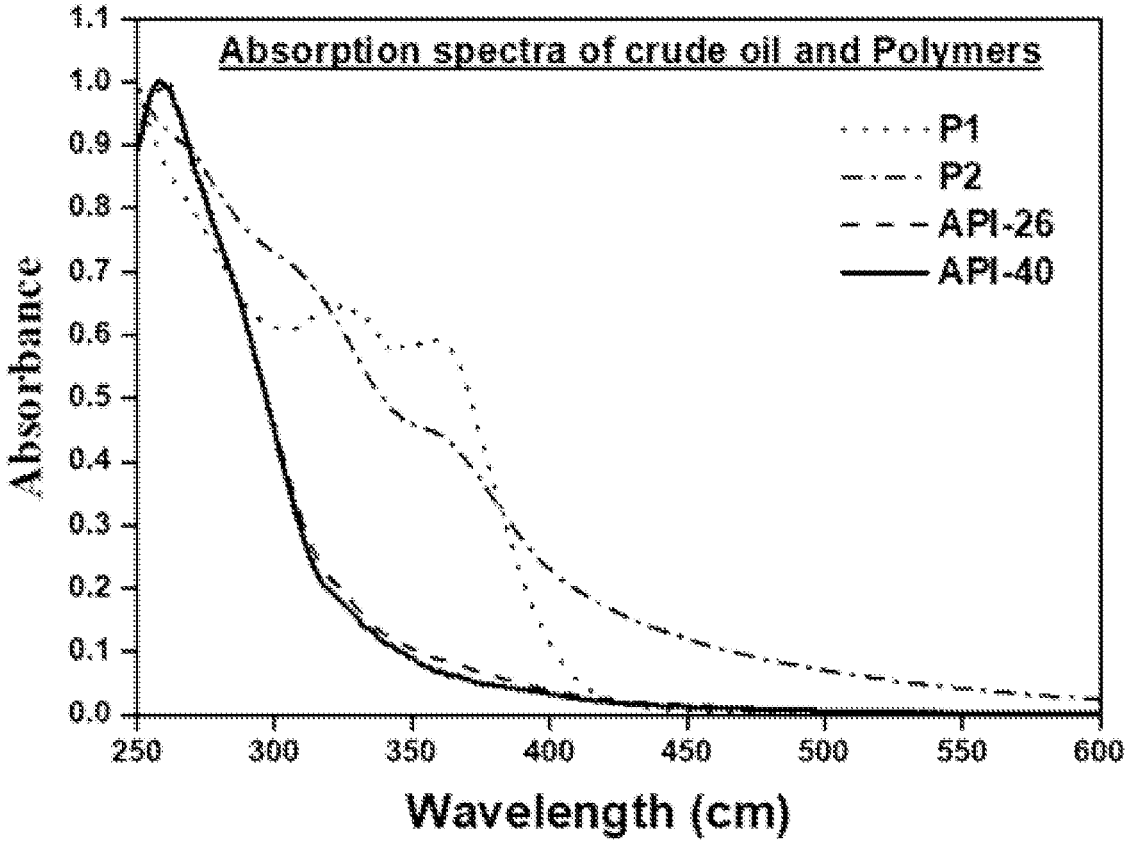
FIG. 5 is the absorption spectra of petroleum polymers (P1, and P2) obtained from crude oils of API-26, and 40, in accordance with an embodiment of the present disclosure.
Figure 6:
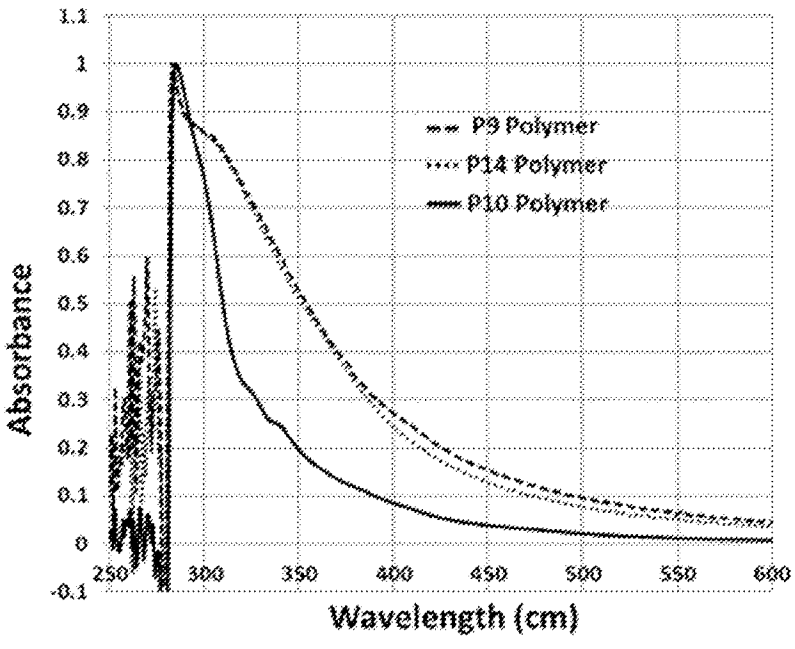
FIG. 6 is the absorption spectra of petroleum fractions and polymers (P9, P10, and P14) obtained from the LCO, VGO and VisTar fractions, in accordance with an embodiment of the present disclosure.
Figure 6:
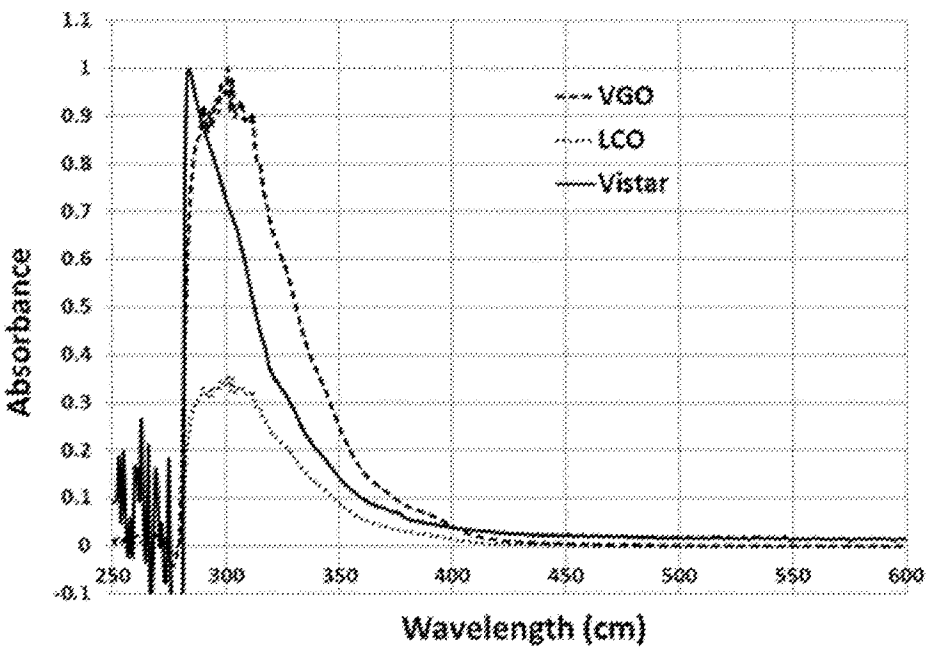
Figure 7:
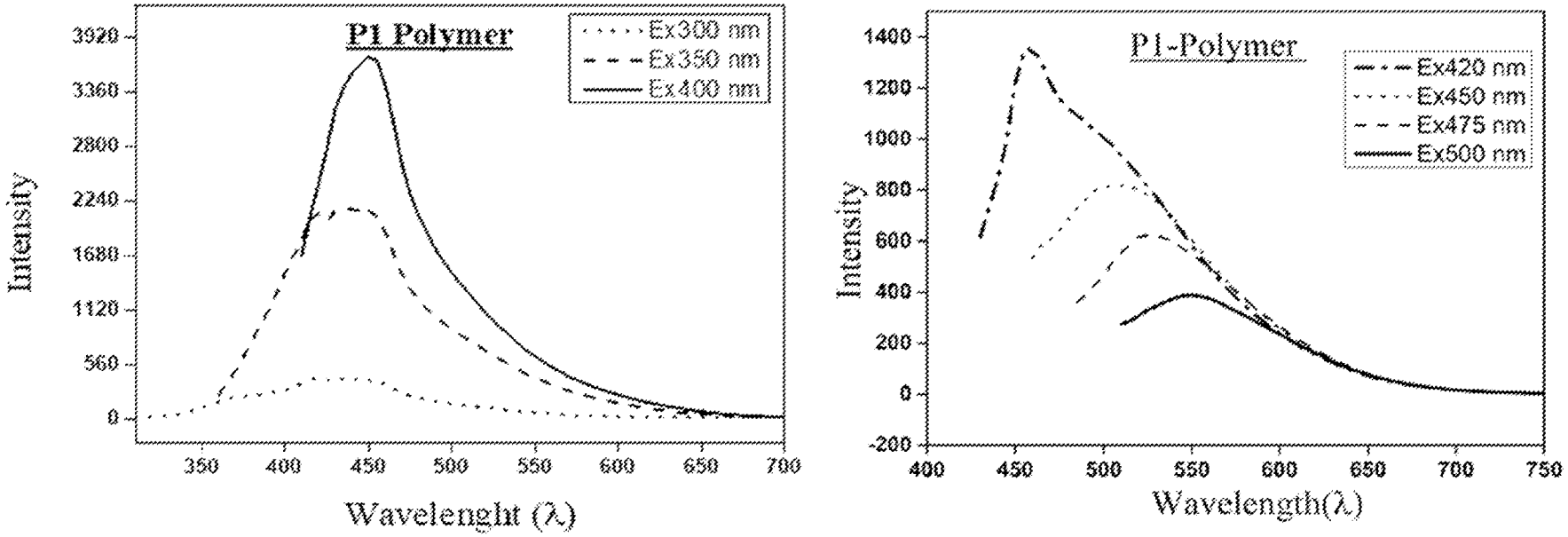
FIG. 7 is the fluorescence spectra of polymer (P1) obtained from API-40 crude at different wavelengths, in accordance with an embodiment of the present disclosure.
Figure 8:
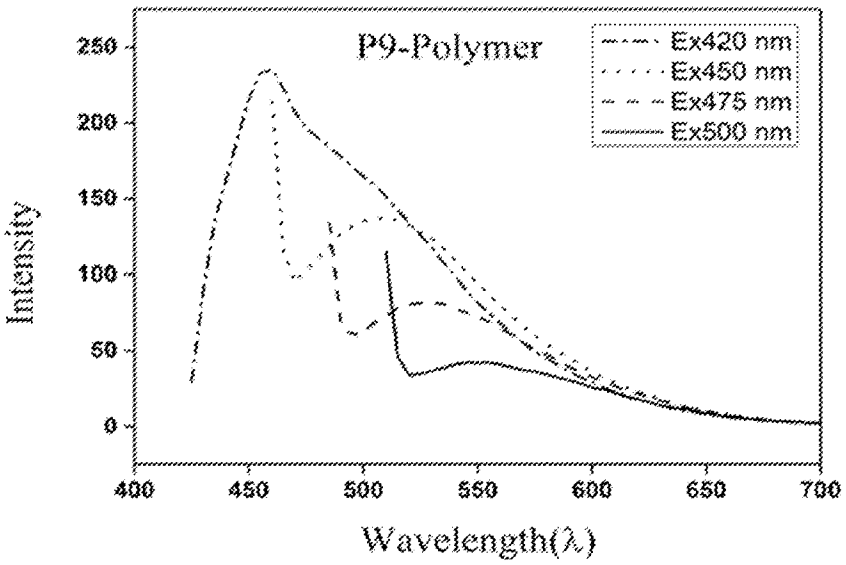
FIG. 8 is the fluorescence spectra of polymer (P9) obtained from the LCO fraction at different wavelengths, in accordance with an embodiment of the present disclosure.
Figure 8:
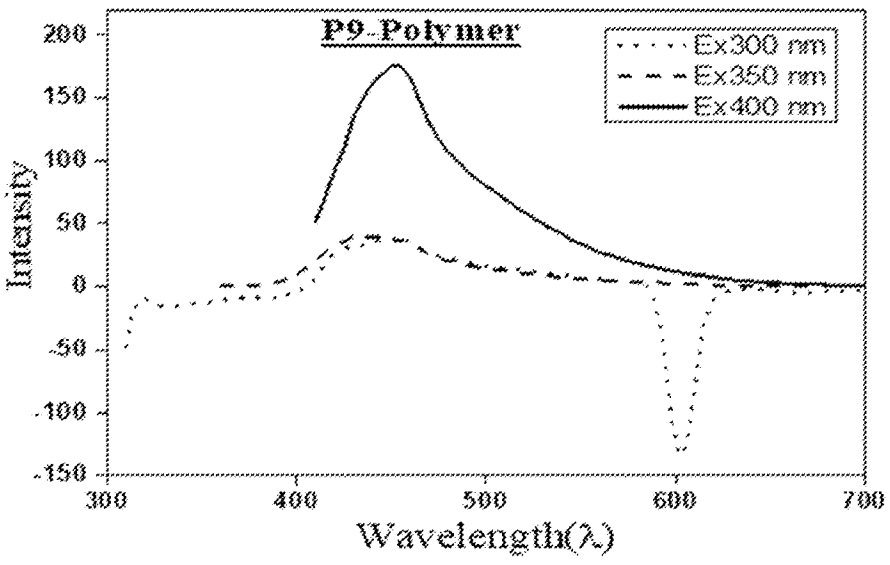
Figure 9:
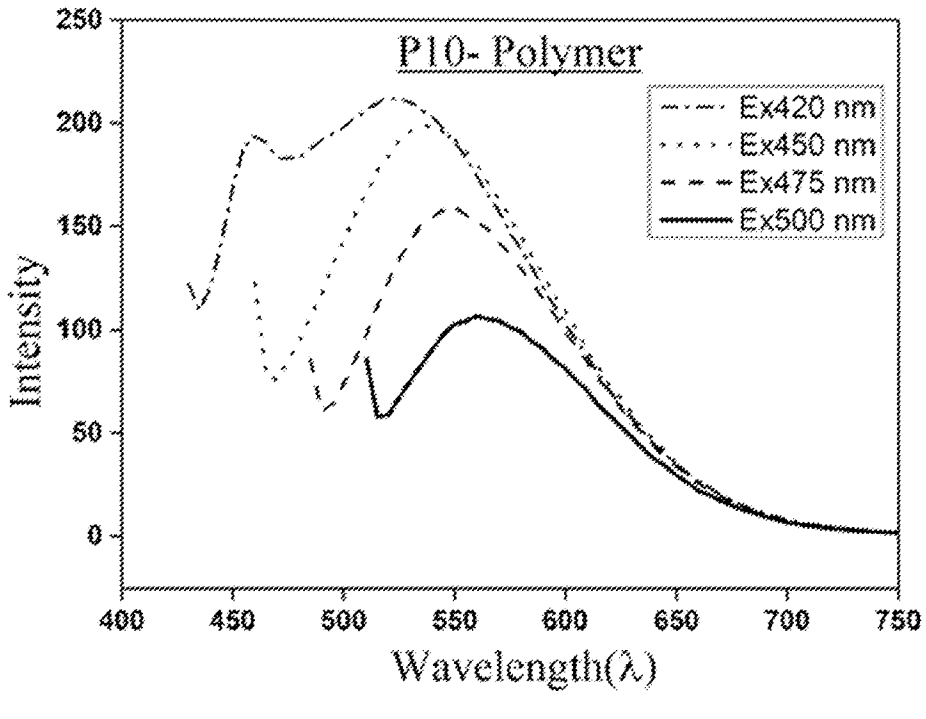
FIG. 9 is the fluorescence spectra of polymer (P10) obtained from the VGO fraction at different wavelengths, in accordance with an embodiment of the present disclosure.
Figure 9:
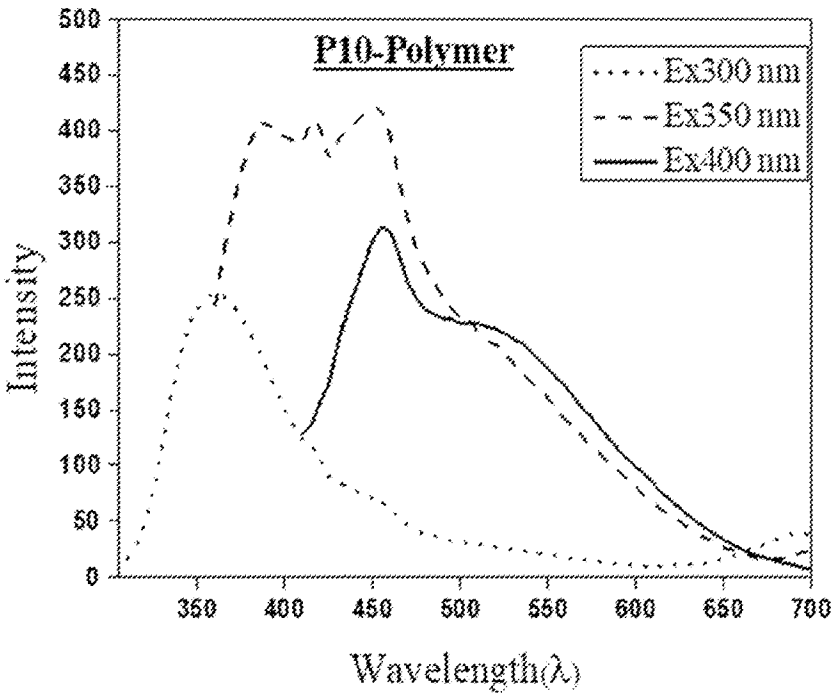
Figure 10:
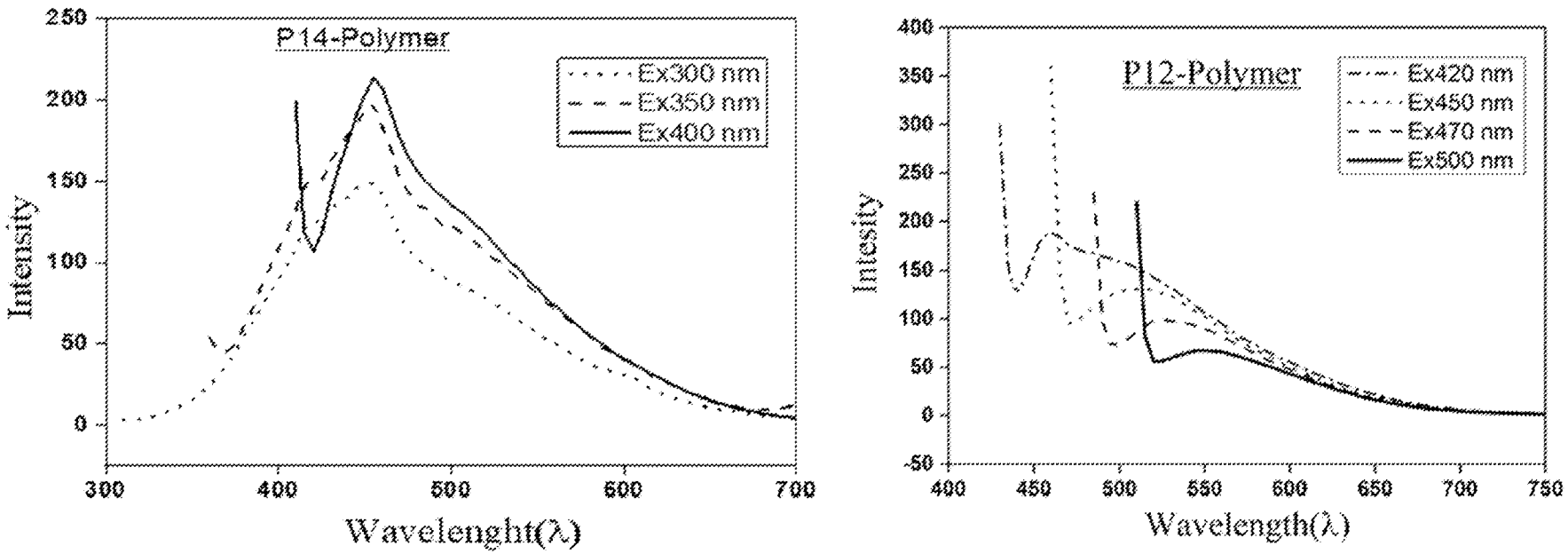
FIG. 10 is the fluorescence spectra of the polymer (P14) obtained from the VisTar fraction at different wavelengths, in accordance with an embodiment of the present disclosure.

The NMR spectrum of the synthesized polymer (P8) from LCO is given in FIG. 3. The characteristic aromatic sulfur compounds represent the aromatic region δ 7-8 ppm. The aromatic region of the polymer has enhanced compared to the crude LCO sample, which contains broad and intense aliphatic protons.

The following examples are given by way of illustration and therefore should not be construed to limit the scope of the present disclosure.

Example 1

Synthesis of poly(thiophene-co-benzothiophene-co-dibenzothiophene) (P1) Using Crude Oil of API-40

20 g of the crude oil (API-40) was taken in a two-neck round bottom flask, and 1 g of $FeCl_3$ catalyst was added through a funnel. The resulting mixture was stirred at 60° C. for 12 h. The resultant polymer was separated by centrifugation. The polymer was dried under vacuum at room temperature. This polymer was designated as P1. The catalyst amount, and sulfur content analysis of the polymerization reactions are summarized in Table 1.

Example 2

Effect of Catalyst Dosage on the Polymerization of Crude Oil Having API-40

The $FeCl_3$ catalyst amount was varied from 0.5, 1, 2, and 3 wt % with respect to the 25 g of the crude oil (API-40). The polymerization process was performed at 60° C. as per the procedure explained in Example-1. The catalyst amount, and sulfur content analysis of the polymerization reactions are summarized in Table 1.

Example 3

Effect of Temperature 20 g of the crude oil (API-40), 1 g of the $FeCl_3$ catalyst, and the reaction temperature was varied from 25, and 70° C. The reaction time was maintained for 6 h. The effect of temperature on the polymerization reaction was studied, and the sulfur content analysis is shown in Table 1.

Example 4

Synthesis of poly(thiophene-co-benzothiophene-co-dibenzothiophene) (P2) Using Crude Oil of API-26

20 g of the crude oil (API-26) was taken in a two-neck round bottom flask, and 1 g of $FeCl_3$ catalyst was added through a funnel. The resulting mixture was stirred at 70° C. for 12 h. After 12 h, hexane was added to the reaction mixture, and the resultant polymer was separated by centrifugation. The polymer was dried under vacuum at room temperature. This polymer was designated as P2. The catalyst amount, and sulfur content analysis of the polymerization reactions are summarized in Table 1.

Example 5

Effect of Catalyst Dosage on the Polymerization of Crude Oil Having API-26

The $FeCl_3$ catalyst amount was varied from 0.002, 0.01, and 0.1, wt % with respect to the 20 g of the crude oil (API-26). The polymerization process was performed at 70° C. as per the procedure explained in Example 4. The catalyst amount, and sulfur content analysis of the polymerization reactions are summarized in Table 1.

Example 6

Synthesis of poly(thiophene-co-benzothiophene-co-dibenzothiophene) (P3) Using Crude Oil of API-18

20 g of the crude oil (API-18) was taken in a two-neck round bottom flask, and 1 g of $FeCl_3$ catalyst was added through a funnel. The resulting mixture was stirred at 70° C. for 12 h. After 12 h, hexane was added to the reaction mixture, and the resultant polymer was separated by centrifugation. The polymer was dried under vacuum at room temperature. This polymer was designated as P3. The catalyst amount, and sulfur content analysis of the polymerization reactions are summarized in Table 1.

Example 7

Synthesis of poly(thiophene-co-benzothiophene-co-dibenzothiophene) (P4) Using Crude Oil of API-15

20 g of the crude oil (API-15) was taken in a two-neck round bottom flask, and 1 g of $FeCl_3$ catalyst was added through a funnel. The resulting mixture was stirred at 70° C. for 12 h. After 12 h, hexane was added to the reaction mixture, and the resultant polymer was separated by centrifugation. The polymer was dried under vacuum at room temperature. This polymer was designated as P4. The catalyst amount, and sulfur content analysis of the polymerization reactions are summarized in Table 1.

Example 8

Synthesis of poly(thiophene-co-benzothiophene-co-dibenzothiophene) (P5) Using the Petroleum Naphtha Fraction 20 g of the naphtha fraction was taken in a two-neck round bottom flask. The flask was filled with a nitrogen atmosphere and 1 g of $FeCl_3$ catalyst was added through a funnel. The resulting mixture was stirred at 25° C. for 12 h. The contents were cooled, and the polymer was separated by centrifugation. The resultant polymer was dried under vacuum at room temperature. This polymer was designated as P5. The catalyst amount, and sulfur content analysis of the polymerization reactions are summarized in Table 2.

Example 9

Synthesis of poly(thiophene-co-benzothiophene-co-dibenzothiophene) (P6) Using the Petroleum Gasoline Fraction 20 g of the gasoline fraction was taken in the two-neck round bottom flask. The flask was filled with a nitrogen atmosphere and 1 g of the $FeCl_3$ was added through a funnel. The resulting mixture was stirred at 25° C. for 12 h. The contents were cooled, and the polymer was separated by centrifugation. The resultant polymer was dried under vacuum at room temperature. This polymer was designated as P6. The catalyst amount, and sulfur content analysis of the polymerization reactions are summarized in Table 2.

Example 10

Synthesis of poly(thiophene-co-benzothiophene-co-dibenzothiophene) (P7) Using the Petroleum Kerosene Fraction 20 g of the kerosene fraction was taken in a two-neck round bottom flask. The flask was kept under a nitrogen atmosphere and 1 g of $FeCl_3$ catalyst was added through a funnel. The resulting mixture was stirred at 25° C. for 12 h. The contents were cooled, and the polymer was separated by centrifugation. The resultant polymer was dried under vacuum at room temperature. This polymer was designated as P7. The catalyst amount, and sulfur content analysis of the polymerization reactions are summarized in Table 2.

Example 11

Synthesis of poly(thiophene-co-benzothiophene-co-dibenzothiophene) (P8) Using the Petroleum Diesel Fraction 20 g of the diesel fraction was taken in a two-neck round bottom flask. The flask was kept under a nitrogen atmosphere and 1 g of $FeCl_3$ catalyst was added through a funnel. The resulting mixture was stirred at 25° C. for 12 h. The contents were cooled, and the polymer was separated by centrifugation. The resultant polymer was dried under vacuum at room temperature. This polymer was designated as P8. The catalyst amount, and sulfur content analysis of the polymerization reactions are summarized in Table 2.

Example 12

Synthesis of poly(thiophene-co-benzothiophene-co-dibenzothiophene) (P9) Using the Petroleum LCO Fraction 20 g of the LCO fraction was taken in a two-neck round bottom flask. The flask was kept under a nitrogen atmosphere, and 1 g of $FeCl_3$ catalyst was added through a funnel. The resulting mixture was stirred at 25° C. for 12 h. The contents were cooled, and the polymer was separated by centrifugation. The resultant polymer was dried under vacuum at room temperature. This polymer was designated as P9. The catalyst amount, and sulfur content analysis of the polymerization reactions are summarized in Table 2.

Example 13

Synthesis of poly(thiophene-co-benzothiophene-co-dibenzothiophene) (P10) Using the Petroleum VGO Fraction 20 g of the VGO fraction was taken in a two-neck round bottom flask. The flask was kept under a nitrogen atmosphere, and 1 g of $FeCl_3$ catalyst was added through funnel. The resulting mixture was stirred at 70° C. for 12 h. The contents were cooled and the polymer was separated by centrifugation. The resultant polymer was dried under vacuum at room temperature. This polymer was designated as P10. The catalyst amount, and sulfur content analysis of the polymerization reactions are summarized in Table 2.

Example 14

Synthesis of poly(thiophene-co-benzothiophene-co-dibenzothiophene) (P11) Using the Petroleum HRO Fraction 20 g of the HRO fraction was taken in a two-neck round bottom flask. The flask was kept under a nitrogen atmosphere, and 1 g of $FeCl_3$ catalyst was added through funnel. The resulting mixture was stirred at 100° C. for 12 h. The contents were cooled, and the polymer was separated by centrifugation. The resultant polymer was dried under vacuum at room temperature. This polymer was designated as P11. The catalyst amount, and sulfur content analysis of the polymerization reactions are summarized in Table 2.

Example 15

Synthesis of poly(thiophene-co-benzothiophene-co-dibenzothiophene) (P12) Using the Petroleum Foots Oil Fraction 20 g of the foots oil fraction was taken in a two-neck round bottom flask. The flask was kept under a nitrogen atmosphere, and 1 g of $FeCl_3$ catalyst was added through funnel. The resulting mixture was stirred at 70° C. for 12 h. The contents were cooled and the polymer was separated by centrifugation. The resultant polymer was dried under vacuum at room temperature. This polymer was designated as P12. The catalyst amount, and sulfur content analysis of the polymerization reactions are summarized in Table 2.

Example 16

Synthesis of poly(thiophene-co-benzothiophene-co-dibenzothiophene) (P13) Using the Petroleum Fuel Oil Fraction 20 g of the fuel oil fraction was taken in a two-neck round bottom flask. The flask was kept under a nitrogen atmosphere, and 1 g of $FeCl_3$ catalyst was added through a funnel. The resulting mixture was stirred at 70° C. for 12 h. The contents were cooled and the polymer was separated by centrifugation. The resultant polymer was dried under vacuum at room temperature. This polymer was designated as P13. The catalyst amount, and sulfur content analysis of the polymerization reactions are summarized in Table 2.

Example 17

Synthesis of poly(thiophene-co-benzothiophene-co-dibenzothiophene) (P14) Using the Petroleum VisTar Fraction 20 g of the VisTar fraction was taken in a two-neck round bottom flask. The flask was kept under a nitrogen atmosphere, and 1 g of $FeCl_3$ catalyst was added through a funnel. The resulting mixture was stirred at 70° C. for 12 h. The contents were cooled, and the polymer was separated by centrifugation. The resultant polymer was dried under vacuum at room temperature. This polymer was designated as P14. The catalyst amount, and sulfur content analysis of the polymerization reactions are summarized in Table 2.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, orders of processes described herein may be changed and are not limited to the manner described herein. Moreover, the actions of any flow diagram need not be implemented in the order shown; nor do all of the acts necessarily need to be performed. Also, those acts that are not dependent on other acts may be performed in parallel with the other acts. The scope of embodiments is by no means limited by these specific examples. Numerous variations, whether explicitly given in the specification or not, such as differences in structure, dimension, and use of material, are possible. The scope of embodiments is at least as broad as given by the following claims.

What is claimed is:

1. A method for desulfurizing a crude oil and/or a sulfur rich petroleum refinery fraction, the method comprising:

feeding the crude oil and/or the sulfur rich petroleum refinery fraction to a reactor;

adding an oxidation catalyst to the crude oil and/or the sulfur rich petroleum refinery fraction;

stirring the crude oil and/or the sulfur rich petroleum refinery fraction and the oxidation catalyst to form a polymer and/or a co-polymer of sulfur-containing heterocyclic compounds; and separating the polymer and/or the co-polymer of sulfur-containing heterocyclic compounds by filtration or by centrifugation, wherein the oxidation catalyst comprises Fe(III)chloride, Fe(III)nitrate, Fe(III) sulphate, Fe(III)phthalocyanine, Cu(II)acetate, Pd(II)acetate, Zn(II)acetate, Ni(II)phthalocyanine, Zn(II)phthalocyanine, Zn(II)chloride, Ni(II) acetate, Ni(II)chloride, Ni(II)nitrate, HAuC14, vanadyl acetylacetonate, or molybdenum acetylacetonate, wherein the polymer comprises polythiophene, an alkylated/alicyclic derivative of polythiophene, polybenzothiophene, an alkylated/alicyclic derivative of polybenzothiophene, polydibenzothiophene, or an alkylated/alicyclic derivative of polydibenzothiophene, and wherein the co-polymer comprises poly(thiophene-co-benzothiophene-co-dibenzothiophene).

2. The method as claimed in claim 1, wherein the co-polymer of sulfur-containing heterocyclic compounds has a formula,

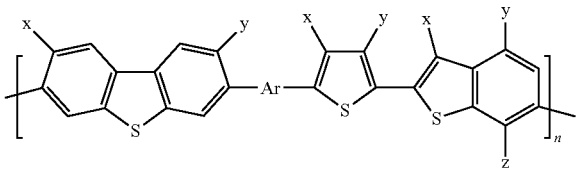

x = H, R
y = H, R
z = H, R wherein R is an alkyl/alicyclic chain substituent, and Ar is an aromatic ring.

3. The method as claimed in claim 1, wherein feeding the crude oil comprises feeding naphtha, gasoline, kerosene, diesel, LCO, VGO, HRO, foots oil, fuel oil, VisTar streams, or a combination thereof.

4. The method as claimed in claim 1, wherein feeding the crude oil comprises feeding a petroleum crude oil having API gravity in a range from 15 to 40.

5. The method as claimed in claim 1, wherein feeding the sulfur rich petroleum refinery fraction comprises feeding sulfur-containing aromatic hydrocarbon compounds.

6. The method as claimed in claim 5, wherein the sulfur-containing aromatic hydrocarbon compounds comprise thiophene, an alkylated/alicyclic derivative of thiophene, a benzothiophene, an alkylated/alicyclic derivative of benzothiophene, dibenzothiophene, and/or an alkylated/alicyclic derivative of dibenzothiophene.

7. The method as claimed in claim 1, wherein adding the oxidation catalyst comprises adding a combination of oxidation catalysts, wherein the combination of catalysts comprises Ni(II)acetate and Cu(II)acetate, Fe(III)chloride and Zn(II)chloride, Fe(III)chloride and Ni(II)chloride.

8. The method as claimed in claim 1, wherein adding the oxidation catalyst comprises adding an amount of the oxidation catalyst in a range of 0.01 wt % to 10 wt % of the crude oil and/or the sulfur rich petroleum refinery fraction.

9. The method as claimed in claim 1, wherein stirring the crude oil and/or the sulfur rich petroleum refinery fraction and the oxidation catalyst comprises stirring under air or an inert atmosphere.

10. The method as claimed in claim 9, wherein the inert atmosphere comprises nitrogen, helium, or argon.

11. The method as claimed in claim 1, wherein stirring the crude oil and/or the sulfur rich petroleum refinery fraction and the oxidation catalyst comprises stirring at a temperature in a range of 0 to 200° C.

12. The method as claimed in claim 1, wherein stirring the crude oil and/or the sulfur rich petroleum refinery fraction and the oxidation catalyst comprises stirring for a period in a range of 6 to 72 hours.

13. The method as claimed in claim 1, wherein stirring the crude oil and/or the sulfur rich petroleum refinery fraction and the oxidation catalyst comprises stirring in presence of toluene, chloroform, hexane, tetrahydrofuran, 1,4-dioxane, or methylene chloride.

14. The method as claimed in claim 1, wherein forming the polymer and/or the co-polymer of sulfur-containing heterocyclic compounds comprises forming the polymer and/or the co-polymer of sulfur-containing heterocyclic compounds in a range from 1 to 30 wt. %.

15. The method as claimed in claim 1, wherein desulfurizing the crude oil and/or the sulfur rich petroleum refinery fraction comprises desulfurizing in a range from 5% to 92%.

16. The method as claimed in claim 1, wherein the co-polymer of sulfur-containing heterocyclic compounds has a molecular weight (Mn) in a range from 500 to 5000.

17. The method as claimed in claim 1, wherein the co-polymer of sulfur-containing heterocyclic compounds is a conducting polymer, and wherein the co-polymer of sulfur containing heterocyclic compounds possesses UV absorbing capabilities, low electrical resistivity, fluorescence, thermochromism, electrochromism, and photochromism.

* * * * *